US005456432A

United States Patent [19]

Ennis et al.

[11] Patent Number: 5,456,432

[45] Date of Patent: Oct. 10, 1995

[54] ADJUSTABLE BABY BOTTLE HOLDER

[76] Inventors: G. Thomas Ennis, 7331 Vista Del Mar La., Playa Del Ray, Calif. 90293; Manochehr Shoushtari, 3731 W. 59th Pl., Los Angeles, Calif. 90043

[21] Appl. No.: 268,521

[22] Filed: Jul. 6, 1994

[51] Int. Cl.[6] ..... A47D 15/00

[52] U.S. Cl. ..... 248/102

[58] Field of Search ..... 248/102, 103, 248/105, 106, 107, 121, 309.1, 176; 215/11.1, 100 R

[56] References Cited

U.S. PATENT DOCUMENTS

| | | | |
|---|---|---|---|
| 1,630,167 | 5/1927 | Cardella | 248/102 |
| 2,457,972 | 1/1949 | Bailey | 248/103 |
| 2,539,698 | 1/1951 | Pearson | 248/103 |
| 2,545,414 | 3/1951 | Pittman | 248/104 |
| 2,907,539 | 10/1959 | Vardan | 248/104 |
| 2,909,346 | 10/1959 | Jones | 248/106 |
| 4,513,935 | 4/1985 | Aguirre | 248/105 |
| 4,902,261 | 2/1990 | Pratt et al. | 248/102 X |
| 4,951,997 | 8/1990 | Kenney | 248/102 X |
| 5,188,320 | 2/1993 | Polka | 248/102 X |

OTHER PUBLICATIONS

The First Years Bottle Handles Advertisement, 1992, Avon, Mass.

*Primary Examiner*—Ramon O. Ramirez
*Attorney, Agent, or Firm*—Staas & Halsey

[57] ABSTRACT

A baby bottle holder for attachment to a support to adjustably hold a baby bottle in a position for feeding a baby includes an L-shaped body member having an upper leg and a lower leg with a pair of spaced handle members extending forwardly from the upper leg in the same direction as the lower leg and being positioned above the lower leg. A first elastic band is attached to the lower leg to surround and hold a baby bottle and a second elastic band is attached to the upper leg to secure the bottle holder to the support.

4 Claims, 2 Drawing Sheets

ADJUSTABLE BABY BOTTLE HOLDER

BACKGROUND OF THE INVENTION

1. Field of the Invention

The present invention relates to an improved baby bottle holder and more particularly to a baby bottle holder which will automatically adjust to whatever position a baby is in so that the baby may comfortably feed from the bottle.

2. Description of the Related Art

Various types of baby bottle holders and supports have been provided for holding nursing bottles for babies but many of these prior art devices have been complex in construction and not easily automatically adjustable so that a baby may feed therefrom in whatever position a baby is in. Moreover, many of these prior art devices are not compact in nature and take up a significant amount of space. Still others are not capable of functioning as a training device for teaching a baby how to feed from a bottle or acting as an educational toy for teaching a baby how to manipulate a bottle.

SUMMARY OF THE INVENTION

It is an object of the present invention to provide a baby bottle holder which can be easily attached to a support such as a portable baby seat, a crib or a baby stroller.

It is another object of the present invention to provide an adjustable baby bottle holder which automatically adjusts to whatever position a baby is in.

It is a further object of the present invention to provide a baby bottle holder which functions as a training device for teaching a baby how to feed from a bottle and as an educational toy for teaching a baby how to manipulate a bottle.

It is still a further object of the present invention to provide a baby bottle holder which is simple in construction and is compact and takes up a minimal amount of space.

The present invention achieves the above objects by providing an automatically adjustable baby bottle holder for attachment to a support to hold a baby bottle in position for feeding a baby. The baby bottle holder includes an L-shaped base member having an upper leg and a lower leg. A pair of spaced handle members extend forwardly from the upper leg in the same direction as the lower leg and are positioned above the lower leg. A first elastic band is attached to the lower leg to surround and releasably hold a baby bottle. A second elastic band is attached to the upper leg to secure the bottle holder to a support. Each of the upper and lower legs include slot means for holding the elastic bands.

These, together with other objects and advantages, which will be subsequently apparent, reside in the details of construction and operation as more fully hereinafter described and claimed, reference being made to the accompanying drawings forming a part hereof, wherein like numerals refer to like parts throughout.

DESCRIPTION OF THE PREFERRED EMBODIMENTS

Figure 1:
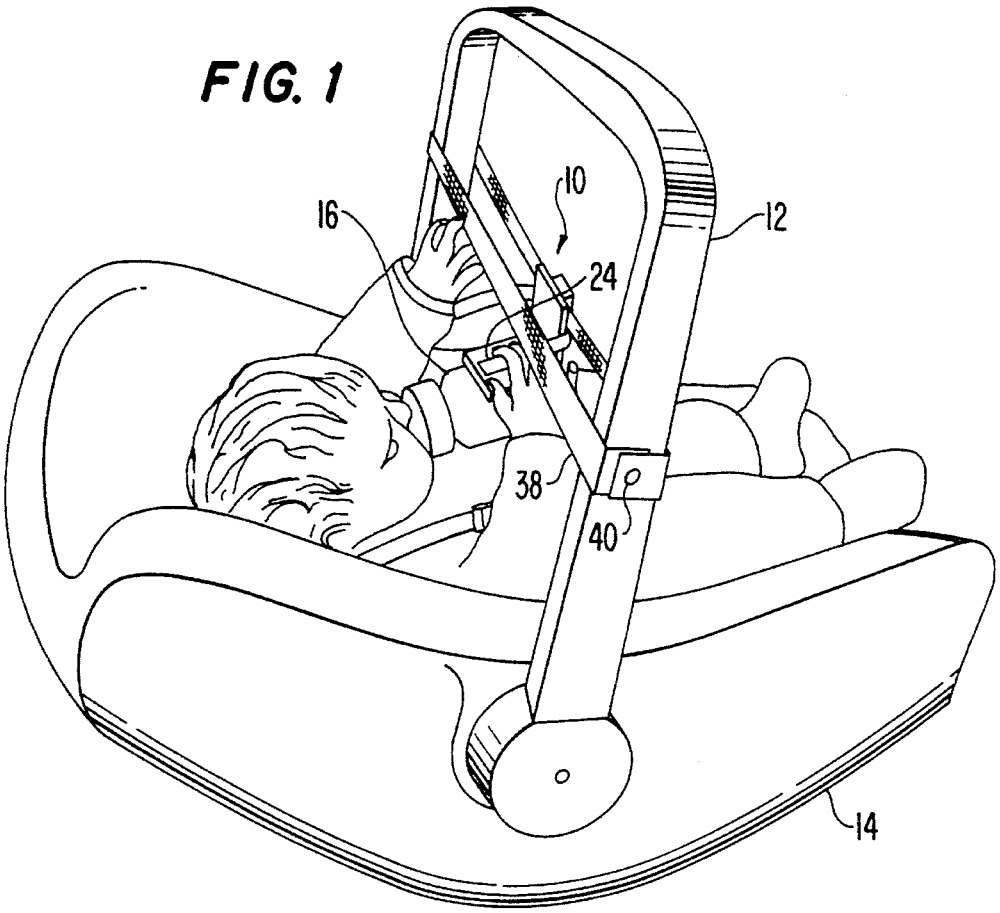
FIG. 1 is a perspective view of a baby bottle holder according to the present invention showing the holder mounted to the handle of a portable baby seat and a baby feeding therefrom.

Referring to the drawings, shown in FIG. 1 is a baby bottle holder 10 attached to an upstanding carrying handle 12 of a portable baby seat 14. A baby bottle 16 is held by the baby bottle holder 10 in a position whereby a baby may easily feed therefrom.

While the baby bottle holder 10 is shown as being mounted on the handle of a baby seat, the bottle holder also is intended for use with other types of suitable supports such as a crib or a stroller. Thus, the baby bottle holder can be mounted between the sides of a crib or between the sides of a stroller.

Figure 2:
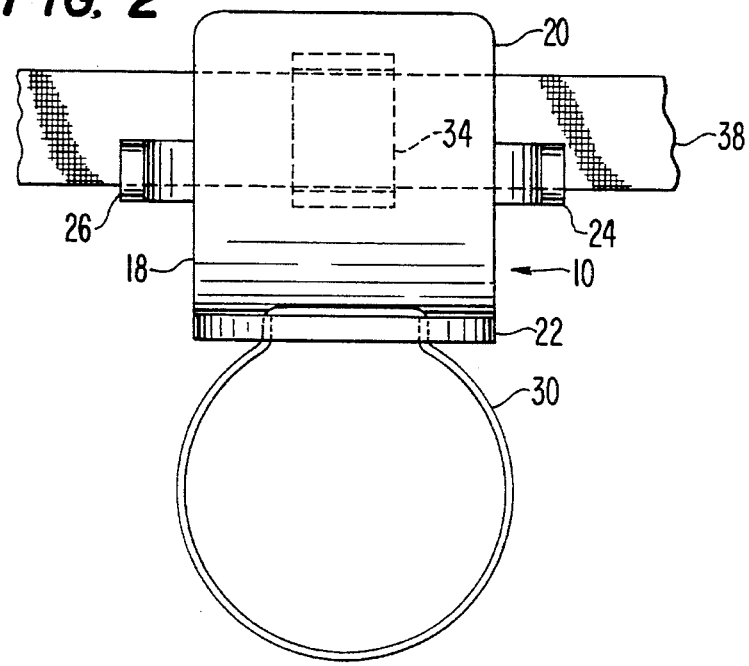
FIG. 2 is a front elevational view of the baby bottle holder of the present invention.
Figure 3:
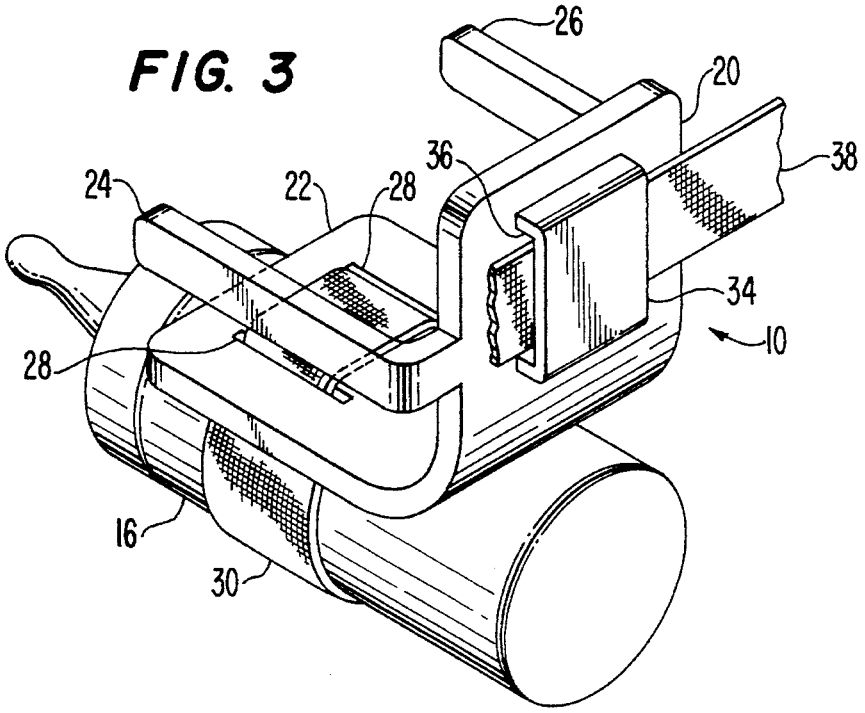
FIG. 3 is a perspective view from the back of one embodiment of the baby bottle holder showing a baby bottle secured to the holder.

As shown in FIGS. 2 and 3, the baby bottle holder 10 includes an L-shaped body member 18 comprised of an upper leg 20 and a lower leg 22. The lower leg and the upper leg are attached to each other at a right angle.

A pair of spaced handle members 24 and 26 extend forwardly from the sides of the upper leg 20 in the same direction as the lower leg 22 extends. The handle members 24 and 26 are positioned above and are generally parallel to the lower leg 22. The handles may be either integral with the body member 18 as shown or may be attached to the upper leg 20 of the body member by suitable fastening means. The body member preferably is made of a suitable plastic material.

Figure 4:
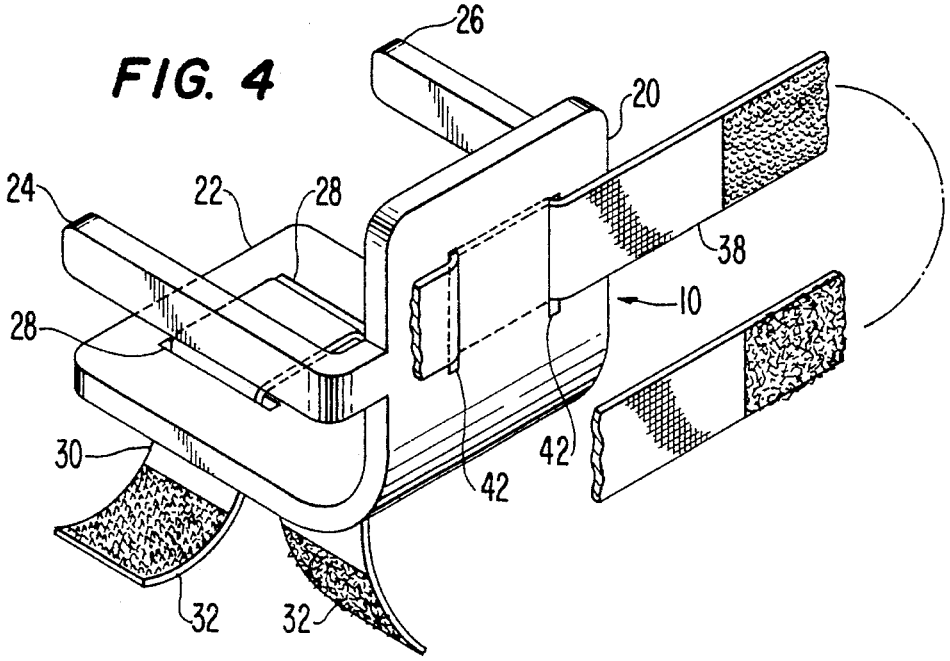
FIG. 4 is a perspective view showing another embodiment of the baby bottle holder employing complementary micro-hook and micro-loop fastening means for the elastic bands.

In the embodiments shown in FIGS. 2–4, the lower leg 22 is provided with a pair of spaced slots 28 for receiving a first elastic band 30. The first elastic band 30 is adapted to releasably hold a baby bottle 16. The elastic band 30 may be comprised of a single unitary band as shown in FIG. 3 or may have a pair of free ends as shown in FIG. 4 having complimentary fastening means 32 of the micro-hook and micro-loop type such as Velcro as shown in FIG. 4. Other types of fastener means may be used such as a snap fastener.

In the embodiment shown in FIGS. 2 and 3, a separate U-shaped channel member 34 is attached to the back side of the upper leg 20 of the holder to form a slot 36 through which a second elastic band 38 passes. The second elastic band 38 is larger than the first elastic band and is adapted to releasably secure the baby bottle holder 10 to a suitable support such as the handle 12 of a baby seat as shown in FIG. 1. The second elastic band may be comprised of either an endless elastic band or an elastic band having a pair of free ends. In the embodiment shown in FIG. 1, the free ends of the second elastic band 38 are fastened together by a suitable snap fastener 40. In the embodiment shown in FIG. 4, the free ends of the second elastic band 38 are fastened together by complimentary fastener means of the micro-hook and micro-loop type such as Velcro.

In the embodiment shown in FIG. 4, a pair of spaced slots 42 are provided in the upper leg 20 whereby the second elastic band 38 is attached to body member 18 by extending through the slots 42.

It is apparent from the above detailed description that many advantageous features are provided by the baby bottle holder of the present invention. The use of an elastic band for holding the baby bottle permits the bottle to be easily adjusted or slid to accommodate a comfortable position for the baby. Similarly, the use of an elastic band to secure the baby bottle holder to a support such as a handle of a baby seat permits the position of the baby bottle holder to be easily adjusted to a comfortable feeding position for the baby. In addition, since the baby bottle holder is suspended from supporting elastic band 38, the bottle may be easily tilted by a baby to a feeding position. Moreover, the use of the handles on the baby bottle holder permit a baby to easily grasp the handles to pull the bottle to a comfortable feeding position.

The baby bottle holder of the present invention functions as a training feeder device for teaching a baby how to feed from a bottle. A baby can be easily trained to tilt a bottle to a suitable feeding position. The holder also functions as an educational toy since a baby learns how to manipulate a bottle by grasping the handles of the holder.

Moreover, the baby bottle of the present invention is simple in construction and does not require a lot of effort to attach to a support member. It is not necessary to use clamps or other devices but only to attach the device through the use of an elastic band. The bottle is also only attached by the use of an elastic band. In addition, the baby bottle holder of the present invention can be folded into a compact size so that it may be easily packed and stored or transported.

Numerous alterations and modifications of the structure herein disclosed will suggest themselves to those skilled in the art. It is to be understood, however, that the present disclosure relates to the preferred embodiments of the invention which is for the purposes of illustration only and is not to be construed as a limitation of the invention. All such modifications which do not depart from the spirit of the invention are intended to be included within the scope of the appended claims.

What is claimed is:

1. A baby bottle holder for attachment to a support to hold a baby bottle in a position for feeding a baby comprising:

an L-shaped body member having an upper leg and a lower leg, wherein when said holder is in its feeding position, said upper leg extends upwardly from said lower leg;

a pair of spaced handle members positioned to be grasped by a baby while feeding, said handle members extending forwardly from said upper leg in the same direction as said lower leg and being positioned above said lower leg;

a first elastic band attached to said lower leg to surround and hold a baby bottle; and a second elastic band attached to said upper leg to secure the bottle holder to said support.

2. A baby bottle holder for attachment to a support to hold a baby bottle in a position for feeding baby comprising:

an L-shaped body member having an upper leg and a lower leg, a pair of spaced handle members extending forwardly from said upper leg in the same direction as said lower leg and being positioned above said lower leg;

a first elastic band attached to said lower leg to surround and hold a baby bottle; and a second elastic band attached to said upper leg to secure the bottle holder to said support: and wherein each of said upper and lower legs include slot means and said first elastic band extends through the slot means of said lower leg and said second elastic band extends through the slot means of said upper leg.

3. A baby bottle holder according to claim 2 wherein each of said slots means comprises a pair of spaced slots formed in said upper and lower legs.

4. A baby bottle holder according to claim 2 wherein said slot means of said upper leg is formed by a U-shaped channel member attached thereto.

* * * * *